United States Patent [19]

Ross

[11] 4,346,768

[45] Aug. 31, 1982

[54] IMPACT DEVICE WITH SINUSOIDAL ROTARY-TO-RECIPROCATIVE CONVERTER

[76] Inventor: Frederick W. Ross, 755 Klamath Dr., Del Mar, Calif. 92014

[21] Appl. No.: 955,488

[22] Filed: Oct. 27, 1978

Related U.S. Application Data

[63] Continuation of Ser. No. 796,404, May 12, 1977, abandoned.

[51] Int. Cl.[3] ..... B25D 15/00

[52] U.S. Cl. ..... 173/118; 60/542; 74/583

[58] Field of Search ..... 173/116, 117, 118, 122, 173/123, 124, 119, 120, 121; 60/594, 542; 74/583

[56] References Cited

U.S. PATENT DOCUMENTS

| | | | |
|---|---|---|---|
| 1,191,948 | 7/1916 | Coates | 173/118 |
| 2,226,559 | 12/1940 | Groom | 173/123 |
| 2,638,749 | 5/1953 | Sparano | 60/542 |
| 2,884,842 | 5/1959 | Schmitz | 173/123 |
| 3,160,217 | 12/1964 | Raihle | 173/123 |
| 4,014,392 | 3/1977 | Ross | 173/118 |
| 4,095,654 | 6/1978 | Ross | 173/118 |
| 4,099,580 | 7/1978 | Ross | 173/118 |
| 4,102,410 | 7/1978 | Ross | 173/118 X |

*Primary Examiner*—Werner H. Schroeder
*Assistant Examiner*—Andrew M. Falik

[57] ABSTRACT

The rotary output of the power source of an impact device is converted to reciprocation of a body, preferably having a resilient coupler, which drives a ram into impacting in an improved rotary-to-reciprocative motion converter including a crankshaft operatively interconnected to reciprocate the body. The converter includes a crankpin bearing, a flat bearing surface secured normal to the reciprocation on a connecting rod or directly on the body, and a constraint spring to hold the flat bearing surface in contact with the bearing during operation. The improved converter provides reciprocation free of angular motion of connecting rods and irregular motion within clearances between moving elements to significantly reduce extraneous harmonic vibrations and energy losses therefrom.

33 Claims, 11 Drawing Figures

IMPACT DEVICE WITH SINUSOIDAL ROTARY-TO-RECIPROCATIVE CONVERTER

This is a continuation, of application Ser. No. 796,404, filed May 12, 1977 abandoned.

BACKGROUND OF THE INVENTION

In impact devices of the type driven by a rotary motor it is necessary to convert the rotary motion of an output shaft to reciprocating motion of a body, usually including a resilient coupler, to drive a ram into impacting against an output tool. In such prior devices the generation of high impacting forces in relatively light weight structures is accompanied by inefficiency of energy conversion caused by unnecessary heating and unwanted harmonic vibrations which seriously waste energy and reduce service life. In particular, considerable such extraneous harmonics are generated by the structural means incorporated to change rotary shaft motion to reciprocating body motion.

In most such prior art devices the rotary-to-reciprocative motion converter includes a connecting rod operatively connected to a crankshaft to reciprocate a body in one of two ways. In the most common of these, the connecting rod is connected with its principal axis in a direct line between a crankpin on a crank on the crankshaft and a wrist pin on the reciprocating body, the principal axis of the connecting rod during each cycle of operation thereby assuming angles up to a maximum of 10 to 15 degress each side of the geometric plane passing through the crankshaft rotational axis and the wrist pin axis. In applicant's U.S. Pat. No. 4,014,392 (3-29-77) the extraneous harmonic vibrations generated by such connecting rods are significantly reduced by incorporating structures for which the aforementioned maximum angles are reduced to less than four degrees.

In other such impact devices a rotary-to-reciprocative motion converter as shown in FIG. 1 also includes a connecting rod 12 operatively interconnecting a crankpin 14 rotating on crankshaft 18 to reciprocate body 15. The extraneous harmonic vibrations generated by angular positioning of the connecting rod interconnected as described hereinabove is avoided by the arrangement illustrated in FIG. 1 by fitting connecting rod 12 to slide axially in bushing 24 and by incorporating slotted connecting rod end 10 with slot sides 20 and 22 in which crankpin 14 is pivoted as crankshaft 18 rotates. (Connecting rod 12 with slotted end 10 is sometimes referred to as a Scotch yoke.) Thus, connecting rod 12 moves in reciprocation ideally without angular positioning during operation. In practice, however, such devices are seriously deficient because the spacing between slot side 20 and slot side 22 must be greater than the outside diameter of crankpin 14 for crankpin 14 to slide in the slot with a practical degree of freedom from friction. Accordingly, during operation there is a tendency for crankpin 14 to impact from side to side as crankshaft 18 rotates because the reactive load on connecting rod 12 reverses during each cycle of operation. Such impacting generates extraneous harmonics of considerable amplitude and induces additional wear on the related surface and crankpin which increases the impacting effects described. When compounded with extraneous harmonics in the reactive forces from body 15, and lateral motion of the connecting rod 12 within the geometrical clearance between connecting rod 12 and bushing 24, necessary for a sliding fit therebetween, significant extraneous harmonic vibrations are generated with resultant unnecessary waste of energy and shortened service life. Connecting rods operatively interconnected in the manner just described are disclosed in U.S. Pat. No. 1,052,823 (2-11-13).

In the third type of rotary-to-reciprocative motion converter used in prior art devices a shaft rotates a cam surface which slides against a second surface. Such devices accordingly are deficient and because of irregular or non-linear motion have severe wear, relatively short service life and generate serious extraneous harmonics.

SUMMARY OF THE DISCLOSURE

An impact device of the type in which a rotary motor mounted on a frame drives a ram into impacting motion against an output tool is disclosed which embodies an improved rotary-to-reciprocative motion converter having: a crankshaft with a crankpin thereon, a bearing with cylindrical outer surface on the crankpin, a reciprocable body mounted for reciprocation along a selected straight path in the device frame, a flat or non-curved plane bearing surface on an element of the reciprocable body positioned laterally with respect to the selected straight path, and a constraint spring.

Such converter elements are structured and positioned so the body and elements secured thereon can reciprocate over a selected excursion greater than the crank throw of the crankpin; and the constraint spring, located between the body and the frame, is positioned and selected with the necessary spring strength and stiffness to constrain the flat bearing surface against the cylindrical outer bearing surface constantly during reciprocation of the body and rotation of the crankshaft.

Preferably the flat bearing surface is positioned on an element of the body to face away from the output tool; and the body is constrained to move in reciprocation with the flat bearing surface constantly in contact with the outer surface of the cylindrical bearing at a point on a side of the cylindrical outer surface of the crankpin bearing toward the output tool. With such positioning of the related elements the constraint force needed is least over that portion of each cycle of operation where the high reaction force from the ram is in a direction and of a magnitude to inherently constrain the flat bearing surface against the crankpin bearing outer surface. The constraint spring has a selected strength and stiffness to continue to hold the flat bearing surface in such contact during the remaining phase of each cycle of operation when the reaction force is smaller and reverses direction. Thus contact between the respective surfaces is maintained at all times with a minimum of spring strength and stiffness, and the force of contact between the bearing outer surface and the flat bearing surface tends toward a minimum.

With the rotary-to-reciprocative motion converter of the invention, crankshaft counterbalancing can be more accurately achieved because the connecting rods have no appreciable angular motion to counteract.

Additionally, a lateral constraint spring positioned between the reciprocable body and the device frame tends to constrain the body in reciprocation against one "side" of the clearance between body and frame guide elements. With a selected positioning and spring strength and stiffness the reciprocating motion is constrained to reciprocate on one "side" of the clearance and hence tends to avoid any extraneous lateral motions from side to side within the clearances between the body and frame guide elements. With this improvement, less accurate fitting between frame and body guide elements can be utilized without generation of significant extraneous harmonic vibrations as typically caused by such less accurate fitting.

The rotary-to-reciprocative motion converter of the invention as disclosed converts crankshaft and hence reciprocating body motion to near sinusoidal reciprocation with a minimum of extraneous harmonics, i.e., the reciprocative motion is mathematically represented by r sin $\theta$ where r is the crank radius and $\theta$ the angular rotation of the crankshaft in radians.

In a preferred embodiment the flat bearing surface is positioned on an element of a connecting rod secured to the body to reciprocate therewith and also to act as a body guide element thereof. This embodiment is distinguished from the Scotch yoke illustrated in FIG. 1 in that the crankpin bearing rolls along only one side of the yoke, being so constrained by the constraint spring, as well as by other features as disclosed hereinbefore. In such an embodiment of the rotary-to-reciprocative motion converter, the connecting rod operatively connects the crankshaft to reciprocate the body, and accordingly, the rotary-to-reciprocative motion converter of the present invention can be incorporated with reciprocable bodies and related features including resilient couplers, instead of the directly linked type of connecting rods disclosed in applicant's U.S. Pat. No. 4,014,392 (3-29-77) and in copending application Ser. No. 762,003 (1-24-77). Additionally, the embodiments of resilient couplers in such references, incorporating structures providing dynamic amplification, are preferred because of the shorter crank radius obtainable therewith which further reduces the tendency to generate extraneous harmonics.

In one embodiment of the present invention a reciprocable body in the form of a drive piston is fitted for sealable reciprocation in a hollow cylinder of relatively larger diameter, which, upon reciprocation drives a ram piston of smaller diameter. The drive piston is driven by a connecting rod secured thereto by action of a crank in the form of a circular eccentric pressed over a shaft common to two otherwise separate rotary motors, one on each side of the eccentric. Rotation of the common motor shaft rotates the eccentric as a crank, and crankpin, and a crankpin bearing thereon rolls reciprocally along the flat bearing surface, thus driving the connecting rod and drive piston into reciprocation along their respective axes. The two motors with a common shaft provide an improved structure for placing the device center of mass substantially on the line of reaction of the ram acceleration force and accordingly reduce extraneous harmonics generated by such an off-set in the center of mass.

The diameter of the drive piston being greater than that of the ram piston reduces the excursion required of the drive piston needed to induce a selected excursion of the ram piston, thereby providing a resilient type of gearing, an important improvement to reduce the crank radius and hence the maximum lateral excursion of the crankpin bearing as it rolls back and forth on the flat bearing surface.

An embodiment utilizing a single rotary-to-reciprocative motion converter with rotary motor and gearing is disclosed in which the advantages of the improved converter are obtained with a motor of higher rotary speed than that of the crankshaft. In this embodiment the flat bearing surface is formed on the upper end element of the reciprocable body and the constraint springs press upward against the bottom of the body.

An embodiment incorporating a single rotary motor with rotary shaft extensions extending from each end thereof with dual connecting rods embodied as elements of an embodiment of the improved rotary-to-reciprocative motion converter of the invention, one incorporated with each such shaft extension, is disclosed. With this embodiment symmetry and a favorable location of the center of mass on the axis of the reciprocating body and impacting ram and other such improvements, as disclosed for the directly linked dual connecting rods in applicant's U.S. Pat. No. 4,014,392 and application Ser. No. 762,003, are obtainable with the double connecting rod embodiment of the improved rotary-to-reciprocative motion coupler of the present invention.

Additionally, with this embodiment a separate cooling motor is incorporated. This is a preferred arrangement for larger impact devices. The cooling motor, preferably electric, is electrically connected to run continuously whether the drive motor is running or not. Thus, it can induce cooling flow continuously whereas the drive motor is stopped periodically while the impact device is reset, e.g., to break off another piece of concrete.

Embodiments illustrating a crank in the form of an eccentric pressed over and keyed to a shaft as well as the more common types of crank are disclosed; and embodiments illustrating alternate structures for connecting rods, body and frame guide elements, and constraint springs are also disclosed.

Other objects and advantages of the present invention will become more apparent from a consideration of the following detailed description and claims in conjunction with the accompanying drawings.

DETAILED DESCRIPTION OF THE PREFERRED EMBODIMENTS

Figure 1:
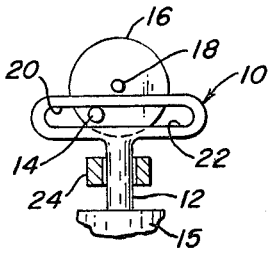
PRIOR ART FIG. 1
FIG. 1 illustrates related features of a prior art rotary-to-reciprocative connecting rod in the form of a Scotch yoke.
Figure 2:
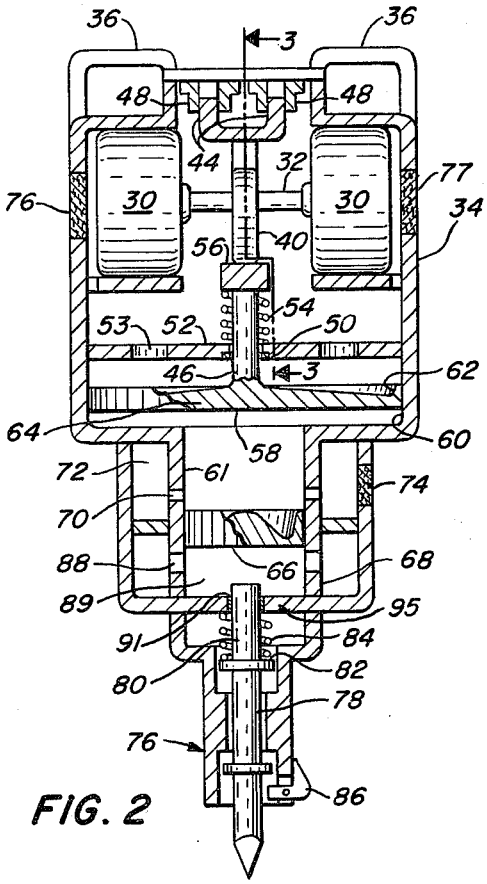
FIG. 2 is a sectional view of an impacting device according to the invention incorporating a single improved rotary-to-reciprocative motion converter having a single connecting rod incorporating a yoke and with an improved cylinder-piston embodiment with a resilient coupler having two pistons each of different diameter, and an improved anvil-bias spring coupler.
Figure 3:
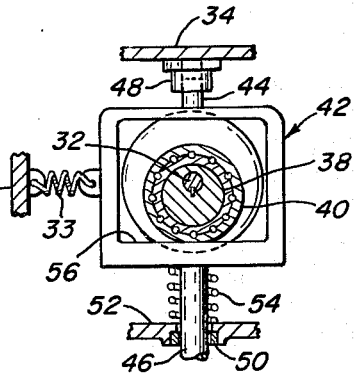
FIG. 3 is an enlarged fragmentary, somewhat diagrammatic sectional view of the embodiment of the invention of FIG. 2 taken along line 3—3.

Referring to the drawings, FIGS. 2 and 3 illustrate a preferred embodiment of the invention. Exciter means in the form of two rotary motors 30, with coaxial shafts secured to operate as a single crankshaft 32, are positioned in a spaced relation symmetrically on frame 34. Frame 34 has handles 36 secured to the top end thereof. Eccentric 38 pressed and keyed to shaft 32 for rotation therewith, preferably has a circular cylindrical outer shape over which anti-friction, non-split bearing 40 having a right circular cylindrical outer surface portion is pressed, eccentric 38 thereby acting both as a crank and a crankpin and bearing 40 as a crankpin bearing. A reciprocable body in the form of drive piston 58 with connecting rod 46 secured thereto with yoke frame 42 secured to connecting rod 46, mounted for reciprocation in frame 34, is reciprocated therein along a selected straight path normal to the axis of crankshaft 32, on guide elements described hereinbelow, upon rotation of crankshaft 32, eccentric 38 and bearing 40. The structural elements of yoke frame 42 which surround bearing 40 are spaced sufficiently therefrom to afford adequate clearance between bearing 40 and yoke frame 42 during operation with rotation of eccentric 38 and reciprocation of yoke frame 42. Yoke frame 42 has two slider shafts 44 secured to the upper element thereof, and a connecting rod 46 secured to the lower element thereof, their respective axes being parallel to serve as non-rotational body reciprocative guide elements, slider shafts 44, and connecting rod 46 are fitted respectively for sliding in barrels 48 secured to frame 34 and bushing 50 mounted in an opening in cross member 52 secured to frame 34.

Constraint spring 54 is supported in compression between yoke frame 42 and frame cross element 52 and tends to hold flat bearing surface 56, which is positioned substantially perpendicular (that is, normal) to the parallel axes of slider shafts 44 and connecting rod 46, firmly against the outer cylindrical surface of bearing 40. Constraint spring 54 has a selected spring stiffness sufficient to hold flat bearing surface 56 constantly against the outer surface of bearing 40 during operation of the device. When incorporated, preferably, with a resilient coupler of the type having dynamic amplification as set forth in U.S. Pat. No. 4,014,392 (3-29-77) and thus having a favorable phase relation between crank angle and ram cyclic motion, with the elements of the rotary-to-reciprocative motion converter, including crank, crankpin bearing, flat bearing surface, connecting rod and constraint spring, positioned as described, the larger reactive force of ram piston 66 reacts on drive piston 58 in a direction to hold bearing surface 56 against crankpin bearing outer surface 40. Accordingly, constraint spring 54 need have only sufficient spring strength, e.g. less than one-third the maximum ram force in the extended spring position, to maintain contact between flat bearing surface 56 and the outer cylindrical surface of bearing 40 during the remainder of each cycle of operation and, when the device is not operating, to maintain such contact during starting transients.

Lateral constraint spring 33 interconnected between connecting rod yoke frame 42 and frame 34 tends to hold yoke frame 42 to one side of the bearing clearances in which connecting rod yoke 42 reciprocates with crankshaft 32 rotated clockwise, i.e. so that when the portion of eccentric 38 between crankshaft 32 and flat bearing surface 56 is moving toward lateral constraint spring 33, these two effects work together to hold yoke frame 42 toward the left as shown, hence a smaller stiffness for spring 33 can accomplish the action desired than would be the case if the rotation of the crankshaft were reversed.

Connecting rod 46 is secured to piston 58 sealably and slidably fitted for reciprocation in hollow drive-piston barrel 60 formed in frame 34. Drive piston 58 is of a high strength design with the web portion 64 tapered from a thicker portion at the axis to a thinner portion near the inner surface of barrel 60. Depending flange 62 provides additional surface at the interface between piston and barrel to improve sealing and decrease pressure acting between the respective surfaces during operation.

Ram piston 66 also of high strength design with tapered web and depending flange is sealably and slidably fitted for reciprocation in hollow ram-piston barrel 61 formed in frame 34, and has flow restricting vents 70 for stabilizing ram piston excursion as disclosed in applicant's copending application Ser. No. 762,003. Vents 70 provide for passage of leakage air past both pistons 58 and 66 to pass into cavity 72, which is vented to the atmosphere through dust-resistant filter 74 in the outer wall of frame 34. As described in more detail hereinbelow, cooling air to motors 30 also flows through filter 76, openings 53 in cross element 52 and the frame cavity containing motors 30, yoke frame 42, and filter 77.

The diameter of drive piston 58 being greater than that of the ram piston 66 provides an air-resilient "gearing" between the respective pistons. Thus, if the area of drive piston 58 is n times that of ram piston 66, e.g. for an excursion of 1 cm, the larger area drive piston will produce the same effect on the ram piston motion as will an excursion of n cm of a drive piston of the same area as that of the ram piston, as commonly incorporated in prior art devices of this type. This air resilient "gearing" is an important improvement when incorporated with the eccentric driven improved rotary-to-reciprocative motion converters disclosed herein. With such "gearing" the lower excursions now required of drive piston 58 and connecting rods 46 importantly reduce the tendencies to generate extraneous harmonics. Additionally, by incorporating the improvement of dynamic amplification disclosed in copending application Ser. No. 762,003, the eccentric crank and all dynamic factors related thereto can be further importantly reduced.

Output means include tool holder 76, releasable tool retainer 86 and anvil 80 as commonly incorporated on prior art impact devices with the improvement of ledge 82 on anvil 80 and bias spring 84 providing work coupled bias force as disclosed in copending application Ser. No. 599,667 U.S. Pat. No. 4,102,410 and the improvement of a relief retainer air spring including the air within the cavity 89 formed by wall elements of frame 34 and ram piston 66 with ram piston 66 at or below the position where openings 88 through the lower portion of barrel 61 are cut-off or closed by ram piston 66. With this embodiment with impact tool 78 unsupported as by a workpiece, anvil 80 and impact tool 78 are pressed down by bias spring 84; the travel and length of anvil 80 being selected so that the top thereof extends below cross element 95 of frame 34 and bushing 91 does not extend above cross element 95. Thus, when impact tool 78 is unsupported, ram piston 66 cannot strike anvil 80 but will move resiliently against the air entrapped in cavity 89, thus relieving the sharp impact force on frame 34 that otherwise would occur and eliminating the heavy coil springs incorporated in prior art devices for such purpose.

Figure 4:
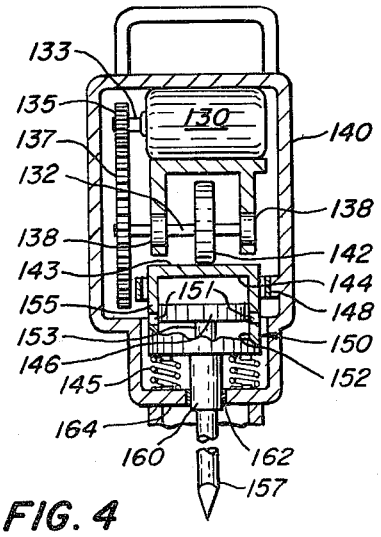
FIG. 4 illustrates an embodiment with a single improved rotary-to-reciprocative motion converter incorporating a related flat bearing surface on the end element of the reciprocable body with constraint springs between the lower end of the body and the frame and having a single rotary motor with gearing.

The embodiment shown in FIG. 4 incorporates a single rotary motor 130 with rotary shaft 133 as exciter means to drive a separate crankshaft 132 through typical gearing as shown. Motor 130, mounted in frame 134, has pinion gear 135 secured to rotate with rotary shaft 133 and to mesh with driven gear 137 secured to rotate crankshaft 132 mounted for rotation in bearings 138 mounted on frame 134. A reciprocable body in the form of cylinder-piston means 150 is slidably mounted on frame guide means in the form of bushings 148 secured on frame 134 and bushing 162 secured on frame cross element 164. Body guide elements in the form of the outer wall of barrel 155 and barrel 160 secured to the lower end of cylinder-piston means 150 match the respective frame guide elements 148 as shown in FIG. 4, for slidable reciprocation of body 150. Ram piston 146 sealably and slidably mounted for reciprocation in barrel 155 has shaft 153 secured thereto and positioned to impact output tool means as is commonly the practice in such prior art devices. Flat bearing surface 143, on end element 144 of cylinder-piston means 150, and eccentric-bearing combination 142, secured to rotate with crankshaft 132, and constraint springs 145 positioned between body 150 and cross element 164 of frame 134 are structured and serve the same purpose as the eccentric-bearing combination and constraint spring 54 of FIG. 3.

Preferably cylinder-piston means 150 is enclosed by end elements secured on barrel 155. With piston 146, cylinder-piston means 150 forms a double air spring. Limited air flow passes through flow restricting vents 151 in the wall of barrel 155 to stablize the piston excursion in barrel 155 during operation.

Figure 5:
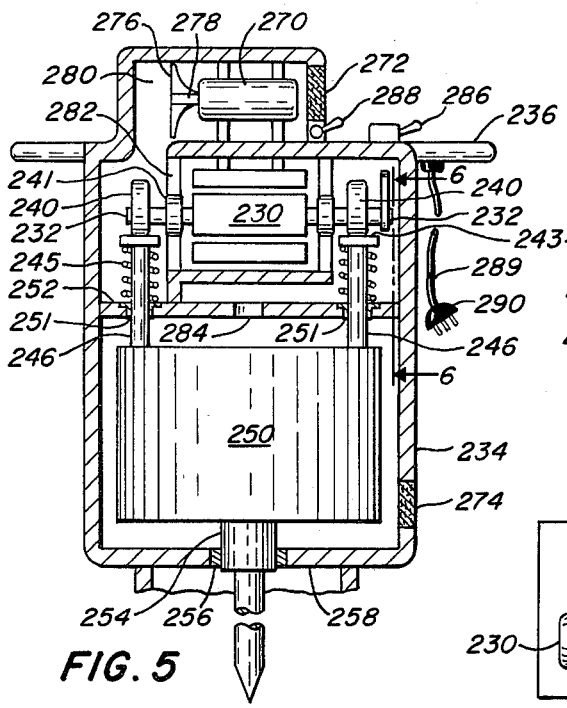
FIG. 5 illustrates an embodiment with a single rotary motor with shaft extension from each end thereof with an improved connecting rod embodiment and with crank in the same rotational phase on each such shaft extension to drive a cylinder-piston coupler, which also incorporates a separate cooling motor.
Figure 6:
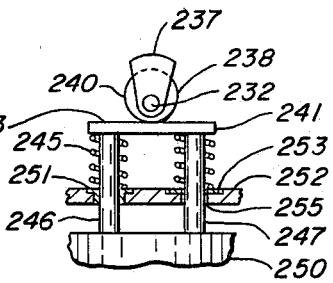
FIG. 6 is a partial sectional end view of the embodiment of FIG. 5, taken along line 6—6, which shows double connecting rods incorporated with each such rotary-to-reciprocative motion converter.
Figure 7:
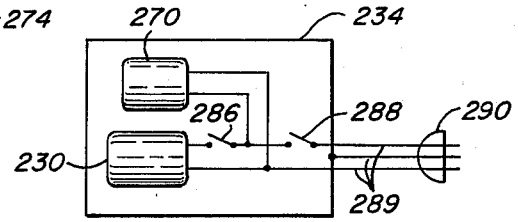
FIG. 7 is a schematic diagrammatic illustration of electrical connections for a separate electric cooling motor in relation to the connections for an electric drive motor.

In FIGS. 5, 6, and 7 an embodiment is disclosed having a single rotary motor 230 for exciter means to frame 234, motor 230 having a rotor shaft extension 232 extending from each end thereof.

An eccentric-bearing combination 240, a flat bearing surface 243 on connecting-rod cross element 241 secured on connecting rods 246 and 247, constraint springs 245 and, except for incorporating two connecting rods on each connecting-rod cross element 241, are structured and positioned in relation to each such shaft extension 232 as the respective elements of the rotary-to-reciprocative motion converter to crankshaft 32 shown in FIGS. 2 and 3. Both such connecting rods 246 and 247, however, are secured to and reciprocate with a reciprocating body shown as cylinder-piston means 250. One connecting rod 246 near each end of motor 230 passes slidably through bushings 251 secured in frame cross element 252. The other connecting rod 247, one also near each end of motor 230, passes through a hole 255 in frame cross element 252 with sufficient clearance to avoid contact with connecting rod 247 but small enough to restrict appreciable cooling air flow therethrough. A loose fitting washer 253 can be added, if preferable. The lower end element of cylinder-piston means 250 which has hollow barrel 254 secured thereto slidably through bushing 256 in frame cross element 258. Pushings 251 and bushing 256 having parallel axes, act as frame guide elements and connecting rods 246 and barrel 254 act as body guide elements to guide body 250 in reciprocation relative to frame 234. Cylinder-piston means 250 acts as a resilient means when reciprocated by the rotation of crankshaft 232 by motor 230 through the connecting rods as described and can be any one of several types of cylinder-piston means, preferably one of the embodiments disclosed in reference U.S. Pat. No. 4,014,392 or copending application Ser. No. 762,003.

FIG. 5 also illustrates an improved means for cooling the exciter means and other elements of the device. Exciter means for driving the impact device is embodied as an electric motor used as rotary drive motor 230 mounted in the device frame, shown as a casing 234 which is substantially dust tight except for dust-resistant inlet filter 272 and dust-resistant outlet filter 274, both filters to permit substantially free flow of air therethrough substantially free of dust. A separate cooling motor 270, preferably electric, smaller, and higher speed than drive motor 230, to provide such cooling as well as positive pressure within casing 234 to reduce penetration of dust into the interior of casing 234 during operation, is mounted on frame 234, adjacent exciter motor 230. Fan 276 secured to rotate with shaft 278, draws air through dust-resistant filter 272 past cooling motor 270 for cooling thereof, through passage ways 280 and 282, through and over drive motor 230 for cooling thereof, and through passage 284 in frame cross element 252 and out through exhaust dust-resistant filter 274, the latter acting to prevent dust and other extraneous matter from entering the case when cooling motor 270 is not operating.

This embodiment of cooling means which is improved over those used in prier art devices is preferred, especially for larger, more powerful units which are preferably extensively operated only with the impact tool hole against a workpiece. With the improved cooling means of the invention, cooling is obtainable continuously whereas the device is only operated intermittently. Additionally, if, under adverse conditions the exciter or main drive motor should overheat, then with the main motor not running, the cooling motor can continue to run thus cooling the main motor much sooner and considerably reducing any shut down time necessary because of such overheating.

Preferably by selection of the pressure loss at inlet filter 272, outlet filter 274 and pressure increase by fan 276 and cooling motor 270, the air pressure inside casing 234 can be maintained sufficiently above outside air pressure to importantly reduce the penetration of dust into casing 234 while cooling motor 270 is running.

Among the most important factors limiting the power obtainable from an electric motor of a given size being the effectiveness of the cooling system incorporated therewith, with the improved cooling obtainable by incorporating a separate cooling motor as disclosed herein, greater power can be drawn practically from a lighter weight, smaller motor. Such improvement is of particular importance for impact devices of the type disclosed herein and in reference U.S.Pat. No. 4,014,302, e.g. in which the drive motor is preferably a slower speed motor when no gearing is used.

Preferably the cooling motor 270 is electrically interconnected with the drive motor 230 as shown in FIG. 7. With these connections the device cannot be run unless the master control, switch 288, is closed so that cooling motor 270 will always be energized before on-off control means, switch 286, can energize motor 230 and operate the device. Accordingly, switch 288 is preferably of the type which will remain either open or closed without being held therein and switch 286 is of the type that must be held in closed position by the operator when operating the device. Thus, with switch 288 closed, the device is operated by closing exciter switch 286, cooling motor 270 thus continuously running when plug 290 is plugged into a powered receptacle unless it is specifically shut off by switch 288. Obviously, the result obtained with switch 288 can also be obtained by pulling plug 290 on electric cable 289 from the power receptacle. Frame 234 is grounded by the connection shown to the third or grounded connector of plug 290.

Figure 8:
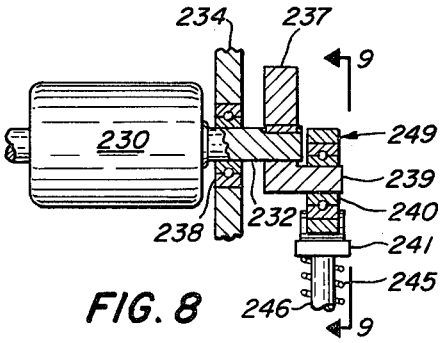
FIG. 8 is a partial sectional view of an alternate embodiment for the rotary-to-reciprocative motion converter illustrated in FIG. 5, incorporating a carriage pressed over a crankpin bearing, the carriage having two smaller cylindrical bearings for rolling against a flat bearing surface.
Figure 9:
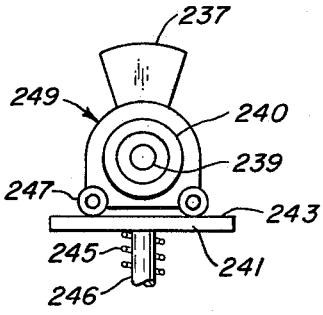
FIG. 9 is a sectional view of FIG. 8 taken along line 9—9.

FIGS. 8 and 9 illustrate a modified embodiment of the rotary-to-reciprocative motion converter of the invention, one such modified converter incorporated on the motor shaft extensions of the impact device illustrated in FIG. 5 A crankpin 239 with counterweight 237 attached in the opposite rotational phase, is keyed and pressed over the end of shaft extension 232. Anti-friction bearing 240 fitted over crankpin 239 has carriage 249 pressed thereover. Carriage 249 has at least two cylindrical rollers 247, preferably also being anti-friction bearings, attached to each lower corner thereof so that, as carriage 249 rolls laterally along flat bearing surface 243, contact is made only with cylindrical rollers 247. Constraint spring 245 acts to hold flat bearing surface 243 in contact with cylindrical rollers 247 during operation. Flat bearing surface 243 is secured to connecting rod 246 which acts to transmit the motion of flat bearing surface 243 to body 250 as for the flat bearing surface 243 and connecting rods 246 and 247 of FIG. 6.

Figure 10:
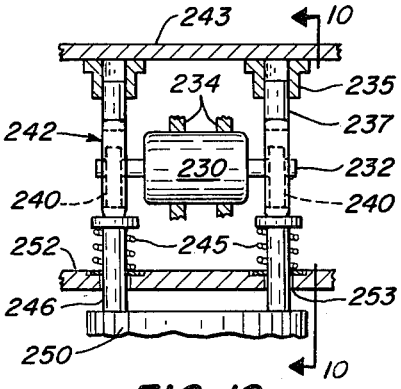
FIG. 10 is an alternate embodiment of the rotary-to-reciprocative motion converter for use with the embodiment of the impact device illustrated in FIG. 5 with a connecting rod yoke and alternate bushing arrangement.
Figure 11:
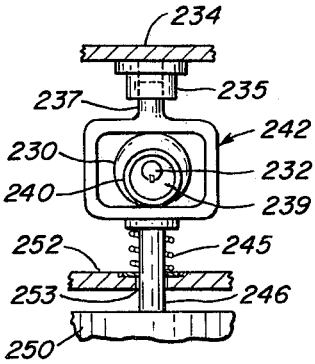
FIG. 11 is a partial sectional end view of the embodiment of FIG. 10.

FIGS. 10 and 11, illustrate another modified embodiment of the rotary-to-reciprocative motion converter portion of FIG. 5 which can be incorporated in the impact device of FIG. 5 instead of the rotary-to-reciprocative motion converter shown there. In this embodiment connecting rod 246 has yoke element 242 operatively interconnected to each shaft extension similar to that of yoke 42 shown in FIG. 3, except as follows: Top rod element 237 secured to yoke frame 242 of connecting rod 246 is supported slidably on frame 234 by only one bushing 235 at the top. Instead of a bushing in frame cross element 252 of frame 234, a hole 253 selected to leave a narrow opening between connecting rod 247 and frame cross element 252 allows reciprocating motion of connecting rod 246 and restricts flow of cooling air therethrough. With this modified embodiment, body 250 with connecting rod 246, yoke frame 242 and connecting rod element 237, one such bushing near each end of motor 230 and one near the bottom of body 250 as illustrated in FIG. 5 provide frame guide means for reciprocation of body 250.

In the foregoing descriptions reference to the directions up, or down, is intended to include away from or towards the impact tool. Also, the reference to a flat surface is intended to include a plane surface that wholly contains every straight line joining any two points lying in the surface.

All the embodiments of the invention disclosed herein are improved over prior art devices by the important reduction in the extraneous harmonic vibrations effected therewith. With such improvements a larger portion of energy put into the device is transmitted to accomplish work of impacting rather than being dissipated in the device to shorten its service life.

Having thus described my invention, I claim:

1. An impact device comprising:

a frame comprising an enclosing ease, a crankshaft rotatably mounted in said enclosing case, exciter means mounted in said enclosing case to rotate said cranshaft, a body mounted for reciprocation along a selected straight path in said enclosing ease, at least one connecting rod operatively connected to said crankshaft to reciprocate said body along said selected straight path upon rotation of said crankshaft, ram means mounted for reciprocation on said enclosing case, resilient means interposed between said body and said ram means for converting reciprocating motion of said body to impacting motion of said ram means, impact tool means operatively mounted on said frame for impact by said ram means during each reciprocation thereof, wherein the improvement comprises:

said exciter means comprising an electric drive motor, a separate electric cooling motor with air pressure fan secured to the shaft thereof for forcing cooling air past said electric drive motor for cooling thereof, motor control means including a master control for energizing both said cooling motor and an on-off control for the electric drive motor whereby said drive motor can only be operated with said cooling motor energized, a dust-resistant inlet filter through which cooling air is admitted into and a dust-resistant outlet filter through which said cooling air is exhausted during operation of said cooling motor, flow channeling elements including frame cross elements within said enclosing case to direct the flow of such cooling air from said inlet filter through said air pressure fan, past said drive motor for cooling thereof, and out through said outlet filter, and said dust-resistant outlet filter is selected to have a pressure loss when such cooling air is flowing therethrough in relation to the pressure losses through the other elements past which such cooling air flows, to provide air pressure within said enclosing case above the ambient air pressure outside the enclosing case during operation of the cooling motor separately and during operation of both motors simultaneously for preventing dust from outside entering the enclosing case, said separate cooling motor, said flow channeling elements, and said motor control means for reducing weight of structure and increasing efficiency of energy usage.

2. An impact device as claimed in claim 1 wherein:

said electric drive motor has a shaft extension extending out each end thereof, and at least one connecting rod operatively connected to each said shaft extension for actuation thereby in substantially the same rotational phase.

3. An impact device as claimed in claim 2 further comprising an element secured to said connecting rod having a substantially flat bearing surface positioned substantially normal to said selected straight path, a crank on said crankshaft, a crankpin bearing on said crank, said crankpin bearing having a substantially cylindrical outer bearing surface, said substantially flat bearing surface positioned to make contact with said substantially cylindrical outer bearing surface during rotation of said crankshaft, and constraint resilient means positioned between said frame and said body and having selected spring strength and stiffness to constrain said substantially flat bearing surface against said substantially cylindrical outer bearing surface during operation of the impact device.

4. A rotary-to-reciprocative motion converter for converting rotary motion of a shaft rotating about an axis in a frame to reciprocate a working body therein over a selected excursion and in sinusoidal motion substantially free of extraneous harmonic vibrations, said rotary-to-reciprocative motion converter comprising:

said frame including attachments secured thereto and mounted thereon, quide means on said frame for guiding said working body along a selected straight path in said frame substantially normal to said shaft and free from impact with said frame and attachments thereto, during reciprocation of said working body over said selected excursion, a crank on said shaft having a selected crank radius less than half said selected excursion and having a crankpin thereon, a crankpin bearing on said crankpin having a cylindrical outer surface, an element secured on said working body for reciprocation therewith and having a substantially flat bearing surface thereon, the position of said shaft, the radius of said crank and the radius of said crankpin bearing outer surface with respect to the reciprocating flat bearing surface during reciprocation thereof are selected for reciprocating motion of said working body moving within said selected excursion with continual contact between said flat bearing surface and the cylindrical outer surface of said crankpin bearing throughout the entire cycle of each rotation of said crankshaft, and constraint resilient means positioned between said frame and said body, having a selected spring stiffness and strength sufficient to force said flat bearing surface continually and firmly in contact with the cylindrical surface of the crankpin bearing throughout the entire cycle of each rotation of the crankshaft under action of reactive forces resulting from reciprocation of said working body.

5. An impact device comprising:

a frame, a crankshaft for rotation on support bearings mounted on said frame, at least one crank on said crankshaft and at least one crankpin on each said at least one crank each said at least one crank having a common selected crank radius, exciter means operatively mounted on said frame to rotate said crankshaft, a body mounted for reciprocating motion along a selected straight path on said frame and free of impacting with other elements of the impact device over a selected excursion of said body greater than twice said common selected crank radius, ram means mounted in said frame and free for reciprocation relative thereto substantially parallel with reciprocation of the body, impact tool means operatively mounted on said frame for impacting thereon by said ram means during each reciprocation thereof, at least one crankpin bearing on each said at least one crankpin, each said crankpin bearing having a substantially cylindrical outer surface, at least one element secured on said body and having a substantially flat bearing surface thereon, each said substantially flat bearing surface positioned substantially normal to said selected straight path and positioned for moving contact with said substantially cylindrical outer surface of one of said at least one crankpin bearing upon reciprocation of said body within said selected excursion with rotation of said crankshaft, constraint resilient means positioned between an element secured on said frame and an element secured on said body, said constraint resilient means acting in a direction substantially along said selected straight path and having a selected spring stiffness and length sufficient to hold said substantially flat bearing surface firmly in contact with the substantially cylindrical outer surface of said crankpin bearing throughout each cycle of rotation of the crankshaft under action of reactive forces during operation of the impact device, and resilient coupler means interposed between said body and said ram means for transmitting energy from said reciprocating motion of said body to energy of the impacting of said ram means against said impact tool means, said resilient coupler means having sufficient resilience to prevent the generation of substantial extraneous harmonic vibrations in the reciprocating motion of said body in reaction to such impacts of the ram on the impact tool means during operation of the impact device, said crankpin bearing outer surface, said flat bearing surface, said constraint resilient means, and said resilient coupler means for converting rotary motion of said crankshaft to sinusoidal reciprocating motion of said body without generation of substantial extraneous harmonic vibrations and for preventing said body while performing such sinusoidal reciprocating motion from generating substantial extraneous vibrations in reaction to the impacting motion of the ram means during operation of the impact device.

6. An impact device as claimed in claim 5 comprising:

non-rotative guide means operatively interposed between said frame and said body and guiding said body in substantially linear reciprocation along said selected path substantially free of extraneous rotations from torques imposed by the body by uneven contact between the substantially cylindrical outer surface of said crankpin bearing and the substantially flat bearing surface, and said non-rotative guide means comprises substantially straight line track means rotationally asymmetric and substantially parallel with respect to the selected path of body reciprocation and at least one track engaging element mounted for guided engagement with the track means during body reciprocation, the track means and the track engaging element being mounted one to the frame, and one to the body.

7. Impact device as claimed in claim 5 wherein said constraint resilient means comprises at least one coil spring.

8. An impact device as claimed in claim 5 wherein said resilient coupler means comprises an air spring.

9. An impact device as claimed in claim 8 wherein:

said air spring comprises a cylinder-piston means having a cylindrical barrel portion positioned with axis substantially normal to the axis of said crankshaft, with one end of said barrel portion toward the axis of said crankshaft and the other end of said barrel portion positioned away from the axis of said crankshaft, said body further comprises a first piston slidably and sealably enclosing the end of said barrel portion toward the axis of said crankshaft, and said ram means comprises a second piston slidably and sealably enclosing said barrel portion positioned away from the axis of said crankshaft.

10. An impact device as claimed in claim 9 wherein said second piston has a ram shaft secured thereto and an end element encloses said other end of said barrel portion positioned away from the axis of said crankshaft and secured thereto, has a bearing thereon through which said ram shaft projects.

11. An impact device as claimed in claim 10 wherein said exciter means comprises a rotary drive motor and gearing operatively engaged to drive said crankshaft in rotation in said support bearings.

12. An impact device as claimed in claim 11 wherein:

said crankshaft is mounted for rotation in said frame on at least two spaced support bearings, said crank is positioned on said crankshaft between at least two of said at least two support bearings, said positioning of support bearings and crank to provide support for said crankshaft acting to reduce deflections thereof and resulting generation of extraneous harmonic vibrations generated thereby during operation.

13. An impact device as claimed in claim 5 wherein said crankpin bearing is an anti-friction non-split bearing.

14. An impact device as claimed in claim 5 wherein said crank comprises an eccentric, with outer surface of substantially circular cylindrical shape, secured to rotate with said crankshaft.

15. An impact device as claimed in claim 5 wherein:

said body reciprocates on guide means comprising body guide elements secured on said body operatively engaging matching frame guide elements on said frame, said body guide elements and said frame guide elements having a sliding fit clearance therebetween for reduced sliding friction, and lateral resilient means positioned between body and frame and substantially normal to said selected straight path to constrain said body in reciprocation to tend to bear on one side only of said sliding fit clearance during operation.

16. An impact device as claimed in claim 5 further comprising at least one connecting rod secured on said body, and said at least one element secured on said body having a substantially flat bearing surface thereon comprises an element secured on said at least one connecting rod.

17. An impact device as claimed in claim 16 further comprising said at least one connecting rod secured on said body in a region toward said crankshaft and fitted for sliding relation along said selected straight path with at least one connecting rod bushing secured in a cross element of said frame, said at least one connecting rod thereby acting as a body guide element to guide said body in reciprocation.

18. An impact device as claimed in claim 17 further comprising a yoke frame secured to said connecting rod, said at least one element secured on said body having a substantially flat bearing surface thereon comprises a portion of said yoke, and a cylindrical shaft extension secured to said yoke on the side opposite said connecting rod and slidably fitted for reciprocation along said selected straight path in a bushing secured to said frame.

19. An impact device as claimed in claim 17 wherein said body comprises a drive piston slidably and sealably fitted for reciprocation in a cylindrical cavity secured in said frame and positioned with cylinder axis aligned with said selected straight path, and said at least one connecting rod is secured axially on said drive piston and extends towards said crankpin bearing through said at least one connecting rod bushing.

20. An impact device as claimed in claim 19 further comprising a guide cylinder secured to said at least one connecting rod and positioned axially parallel with the axis of said drive piston, and offset therefrom, and a matching barrel secured to said frame, said guide cylinder fitted for sliding relation in said matching barrel.

21. An impact device as claimed in claim 16 wherein said constraint resilient means comprises a coil spring surrounding said at least one connecting rod.

22. An impact device as claimed in claim 5 further comprising at least two cranks on said crankshaft in a spaced relation in substantially the same rotational phase, each said at least two cranks having one of said crankpin bearings thereon, at least one of said at least one element secured on said body and having a substantially flat bearing surface thereon positioned for moving contact with the outer surface of each said crankpin bearing.

23. An impact device as claimed in claim 22 wherein said exciter means comprises a rotary motor with a rotary output shaft having a shaft extension extending from each end of said rotary motor, at least one of said at least two cranks with at least one said crankpin bearing thereon on each said shaft extension operationally interconnected to maintain contact with the substantially flat bearing surface on at least one of said at least one element secured on said body and having a substantially flat bearing surface thereon.

24. An impact device as claimed in claim 23 wherein each said at least one element secured on said body and having a substantially flat bearing surface thereon is secured to a connecting rod secured to said body.

25. An impact device as claimed in claim 24 wherein each said at least one element secured on said body and having a substantially flat bearing surface thereon is secured to two connecting rods secured to said body to provide greater rigidity to the support of said surface to reduce extraneous harmonics resulting therefrom during operation.

26. An impact device as claimed in claim 23 wherein each said crank comprises an eccentric having a circular cylindrical outer shape, and each said at least one crankpin bearing comprises an anti-friction non-split bearing.

27. An impact device as claimed in claim 23 wherein each said at least one of said at least two cranks with at least one crankpin thereon is secured to an end fitting secured to each said shaft extension with said crankpin extending beyond the end of said shaft extension.

28. An impact device as claimed in claim 27 further comprising an anti-friction bearing on each said crankpin.

29. An impact device as claimed in claim 28 further comprising a carriage fitted over each said anti-friction bearing and having at least two cylindrical bearings for making contact with said substantially flat bearing surface.

30. An impact device as claimed in claim 27 wherein each said crankshaft end fitting further comprises a counterweight positioned in opposite phase with said crankpin secured on said end fitting.

31. An impact device as claimed in claim 5 further comprising a counterweight positioned on said crankshaft adjacent to and in opposite rotational phase with each said at least one crank.

32. An impact device comprising:

a frame, a crankshaft rotatably mounted on said frame, exciter means operatively mounted to rotate said crankshaft, drive piston means mounted for slidable and sealable reciprocation in hollow drive cylinder means fixed in said frame, the axis of said hollow drive cylinder means positioned in a selected direction in said frame, at least one connecting rod operatively connected to said crankshaft to reciprocate said drive piston means in said selected direction upon rotation of said crankshaft, ram means comprising a ram piston sealably and slidably mounted in a hollow ram cylinder secured to said frame, said ram piston free for reciprocation relative to said hollow ram cylinder substantially parallel with said selected direction upon reciprocation of the drive piston means, air spring means for converting reciprocating motion of said drive piston means to impacting motion of said ram means, impact tool means operatively mounted on said frame for impact thereon by said ram means during each reciprocation thereof, wherein the improvement comprises:

said drive piston means having larger cross sectional area $A_d$ normal to said selected direction than the cross sectional area $A_r$ of said ram piston normal to said selected direction, a sealing transition section fixedly securing and sealing said hollow drive cylinder means to said hollow ram cylinder with the respective axes thereof substantially parallel, said air spring means comprising an enclosing wall substantially enclosing a space of variable volume, said enclosing wall comprising said drive piston means, said hollow drive cylinder means, said sealing transition section, said hollow ram cylinder, said ram piston, and a mass of air substantially enclosed in said enclosing wall, and the larger area of said drive piston means $A_d$ relative to the smaller area of the ram piston $A_r$ acting to reduce the maximum excursion required of the drive piston means to effect a selected excursion for the ram piston in the ratio of $A_r/A_d$ thereby reducing generation of extraneous harmonics generated by such reduced maximum excursion during operation of the device.

33. An impact device comprising:

a frame, a crankshaft rotatably mounted on said frame, exciter means mounted on said frame, a body mounted for reciprocation along a selected straight path on said frame, at least one connecting rod operatively connected to said crankshaft to reciprocate said body along said selected straight path upon rotation of said crankshaft, ram means mounted for reciprocation in said frame, resilient means interposed between said body and said ram means for converting reciprocating motion of said body to impacting motion of said ram means, impact tool means operatively mounted on said frame for impact by said ram means during each reciprocation thereof, wherein the improvement comprises:

said at least one connecting rod operatively connected to said crankshaft in the mid-region of the length of said crankshaft, and said exciter means comprises two rotary motors, one positioned on each side of said connecting rod, and said crankshaft comprises a rotary shaft common to both said two motors, such positioning of said two rotary motors providing means for significant reduction of reactive frame rotational torques from said drive piston during operation.

* * * * *